US006095391A

United States Patent [19]

Fiske et al.

[11] Patent Number: 6,095,391

[45] Date of Patent: Aug. 1, 2000

[54] METHOD AND APPARATUS FOR LOOP STABILIZATION WITH FORCED AIR

[75] Inventors: John Mayo Fiske, Wakefield; John Fairhurst, Lawrence; Stephen E. Silva, Concord, all of Mass.; Bruce Taylor, Manchester, N.H.

[73] Assignee: Roll Systems, Inc., Burlington, Mass.

[21] Appl. No.: 09/129,327

[22] Filed: Aug. 4, 1998

[51] Int. Cl.[7] ..... B65H 23/185; B65H 23/192; B65H 23/24

[52] U.S. Cl. ..... 226/42; 226/113; 242/417.1; 242/418.1

[58] Field of Search ..... 242/417.1, 615.11, 242/615.12, 147 A, 413.3, 413.4, 413.5, 413.6, 413.7, 413.8, 418.1, 419.1, 419.3, 420.3, 420.6, 421.5–421.9; 226/97.1, 97.2, 97.3, 97.4, 118.1, 113, 42

[56] References Cited

U.S. PATENT DOCUMENTS

| | | | |
|---|---|---|---|
| 2,678,173 | 5/1954 | Phelps | 242/417.1 |
| 2,796,223 | 6/1957 | Detweiler | 242/417.1 |
| 3,908,920 | 9/1975 | Hermanns | 242/417.1 |
| 4,050,642 | 9/1977 | Katsumata et al. | 242/417.1 |
| 4,498,638 | 2/1985 | Kurtz et al. | 242/417.1 |
| 5,588,345 | 12/1996 | Franks et al. | 242/417.1 |
| 5,709,352 | 1/1998 | Rogers et al. | 242/417.1 |
| 5,924,619 | 7/1999 | Bartell | 226/97.3 |

FOREIGN PATENT DOCUMENTS

| | | | |
|---|---|---|---|
| 245750 | 5/1987 | Germany | 242/417.1 |
| 816859 | 7/1959 | United Kingdom | 242/417.1 |

*Primary Examiner*—John M. Jillions
*Attorney, Agent, or Firm*—Cesari and McKenna, LLP; William A. Loginov

[57] ABSTRACT

A method and apparatus is presented for stabilizing a free loop of web material between two web handling devices. The present invention employs fans or other forced air sources, directed toward the inner surface of the free loop, to maintain a stable free loop shape, thereby permitting simplified web handling and more accurate control of the web feeding or web take-up rate.

13 Claims, 8 Drawing Sheets

METHOD AND APPARATUS FOR LOOP STABILIZATION WITH FORCED AIR

FIELD OF INVENTION

This invention relates to feeding of a continuous web of material. More particularly, this invention relates to the control of web feed using forced air to stabilize a free loop of web material between web handling devices.

BACKGROUND OF THE INVENTION

There are a variety of currently available web feeding machines. These machines match speed between the web feeder and a web take-up device such as a printer. However, existing speed matching techniques do not perform well in applications requiring high throughput speeds or widely varying speeds.

Existing machines often rely upon a weighted bar or dancer that rides on the web between the web feeding device and the web take-up device. The dancer pivots to apply consistent weight to the loop of web material formed between the web handling devices, which holds the web in place. A sensor, such as a variable resistor, is further employed to detect the position of the dancer and, as a result, the amount of free web material in the loop between the web feeding device and the web take-up device. In this manner, the web feeder's rate can be adjusted to supply web material at a rate consistent with the demands of the take-up device. This weighted bar approach may be adequate for some applications. However, the loop of web material becomes unstable at high speeds. Also, when used with take-up devices such as impact printers or bursters, which have widely varying speeds, this prior art arrangement is quite inadequate since the bar will bounce during abrupt speed changes. Accordingly, an object of the present invention is to match speed between a web feeding device and a web take-up device in applications with widely varying speed requirements.

The weighted bar device additionally places substantial strain on the pin feed holes in the web material. This is particularly a problem when handling light weight paper. Even with the weight of the dancer counterbalanced, the speed changes in a typical web feeding operation cause inertial forces that distort the pin feed holes. This tension complicates the paper steering operation, requiring exact alignment and trim. Accordingly, it is an object of the present invention to provide a technique for joining a web feeding device and a web take-up device that does not require the use of dancers or the careful alignment of web material and machinery.

Another technique for speed matching involves the use of a "free loop," where the web feeder is connected directly to the web take-up device while the intervening web material hangs freely between the two apparatuses. In this case a sensor, such as an optical or ultrasonic detector positioned under the loop, is typically employed to sense the depth of the web material loop. The web feeding machine, in turn, uses the measured loop depth to control the web feeding rate. However, this approach is prone to instability whenever operating conditions cause the loop shape to deform. Further, if the feed rate drops sharply, the unrestricted loop of web material may crease, twist, or completely derail from the web feeder or the take-up device, requiring operator intervention and interruptions to the web handling process. This approach also suffers from difficulties where the loop shape deforms in response to environmental conditions such as external air currents.

Accordingly, it is an object of the present invention to provide a consistent free loop shape between two web handling devices to permit accurate sensing and speed matching.

SUMMARY OF THE INVENTION

To accomplish the foregoing and other objects, features, and advantages of the invention there is provided an apparatus for stabilizing the free loop between a first web handling device and a second web handling device which employs a forced air source directed into the free loop so that loop shape is maintained during handling.

In a preferred embodiment, the first web handling device is a web feeder which supports a roll of web material and dispenses the material at a controlled rate. The web material may be paper or may be other forms of web material generally supported in a web feeder. The second web handling device is a printer, burster, collator, inserter, or other like machine that draws the web material thereto for processing.

The present invention comprises a source of forced air and apparatus for directing the forced air toward a loop of web material formed between the first and second web handling devices during operation. In one embodiment, the source of forced air is external compressed air with appropriate nozzles. In another embodiment, the source of forced air is one or more fans. The forced air source may be connected directly to the web feeder, or may comprise a stand alone unit placed between the web feeder and the web utilization apparatus. Additionally, the forced air source may be pivotally mounted to allow control over the direction of the forced air.

Alternatively, the present invention comprises a method for loop stabilization using forced air as described herein.

BRIEF DESCRIPTION OF THE DRAWINGS

The invention description below refers to the accompanying drawings, of which.

DETAILED DESCRIPTION OF THE PREFERRED EMBODIMENTS

The loop stabilizing invention can be used in a web feeding apparatus adapted to supply web material as might be fed into, for example, a laser printer. One of the substantial improvements relates to the use of forced air to maintain consistent loop shape regardless of external air currents and variations in web feeding rate. This stabilized loop provides many benefits. It relieves tension from between the web handling devices. It permits more accurate control of the rate at which the web feeder provides material by ensuing that factors such as the weight of the web material, varying speed demands of the web utilization apparatus, and environmental air currents do not deform the loop shape. Further, the invention provides these benefits in a manner that causes no marking or creasing of the web material and in a manner that requires no special alignment or handling procedures.

Figure 1:
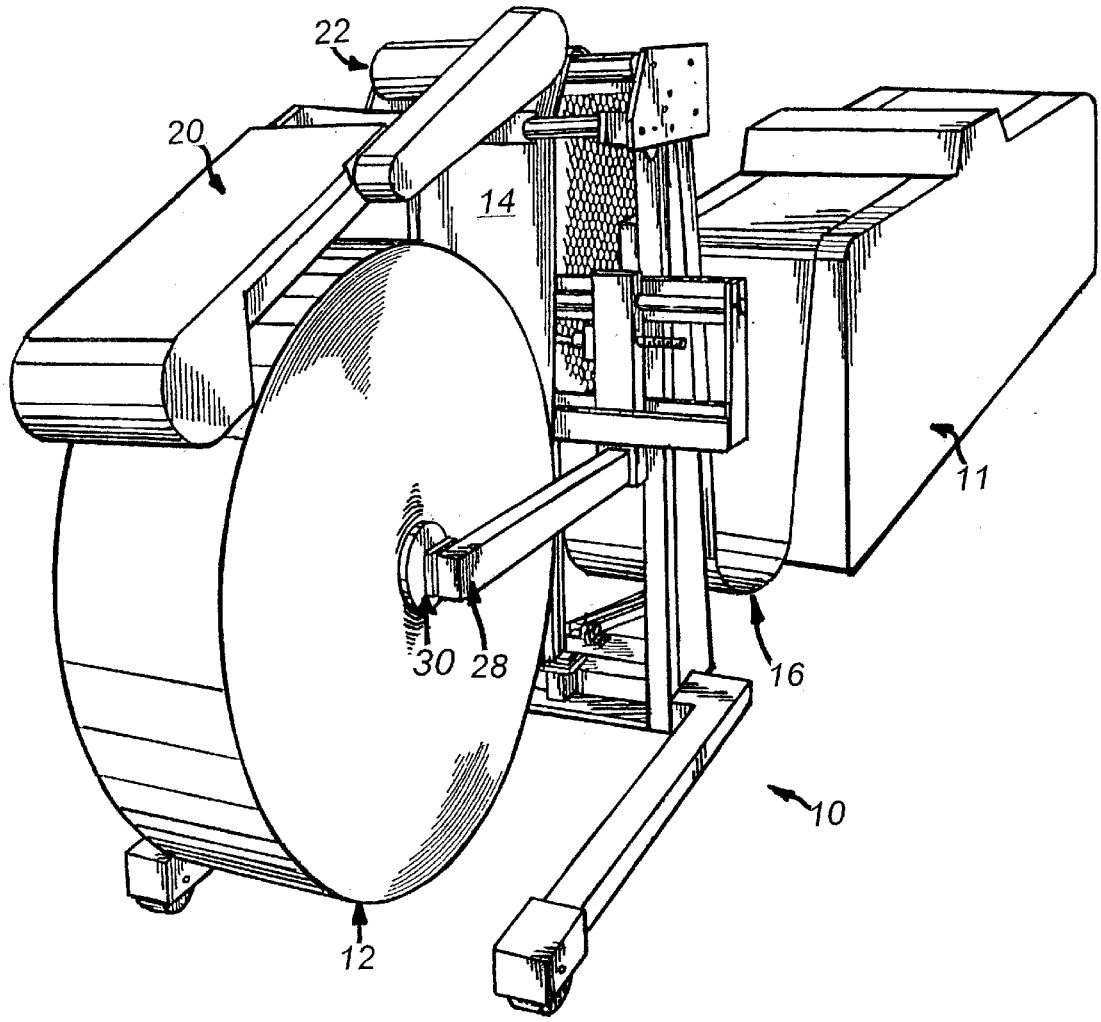
Fig. 1 (PRIOR ART)
FIG. 1 is a perspective view of a prior art web feeder and web utilization apparatus.

Referring now to the drawings, FIG. 1 shows a web feeding machine 10 and a utilization apparatus 11. The web feeding machine 10 supports a large roll 12 of web material 14 that may be, for example, a roll of paper comprised of several continuous forms separated by perforations. The web material 14 forms a loop 16 between the web feeding machine 10 and the utilization apparatus 11. The utilization apparatus 11 may be, for example, a printer, burster, collator, inserter, or a combination machine. It should be appreciated that the foregoing invention may be likewise practiced with any web feeding process, such as a utilization apparatus feeding out to a web take-up device, where it is necessary to control the rate of web take-up rather than the rate of web feed.

The web material roll 12 is typically supported by support arms 28 with chucks 30 adapted to move into a core of the material roll 12. The web feeding machine 10 will also include some mechanism for rotating the web material roll 12 on the chucks 30 at a controlled rate to supply web material, such as a belt 20 driven by a motor 22. In a prior art free loop process, the motor 22 and belt 20 receive control signals which control the rate of web feeding in response to one or more sensors (not shown) which detect the depth and/or shape of the loop 16. This function is performed by transmitting signals from the sensors to a control box 29 (FIG. 2) attached to the web feeding machine 10, which in turn generates appropriate rate signals to the motor 22 so that the loop 16 maintains its shape and depth. The motor 22 and belt 20 may also be operated manually during certain operations, such as loading a roll 12 into the web feeding machine. The motor 22 and belt 20 may similarly be placed on a web take-up device and receive control signals which control the rate of web take-up in response to the sensed shape of the loop 16.

A typical web handling device incorporating the features discussed above is described in U.S. Pat. No. 5,472,153, entitled Roll Support and Feed Apparatus, issued on Dec. 5, 1995 to H. W. Crowley, et al., incorporated herein by reference.

Figure 2:
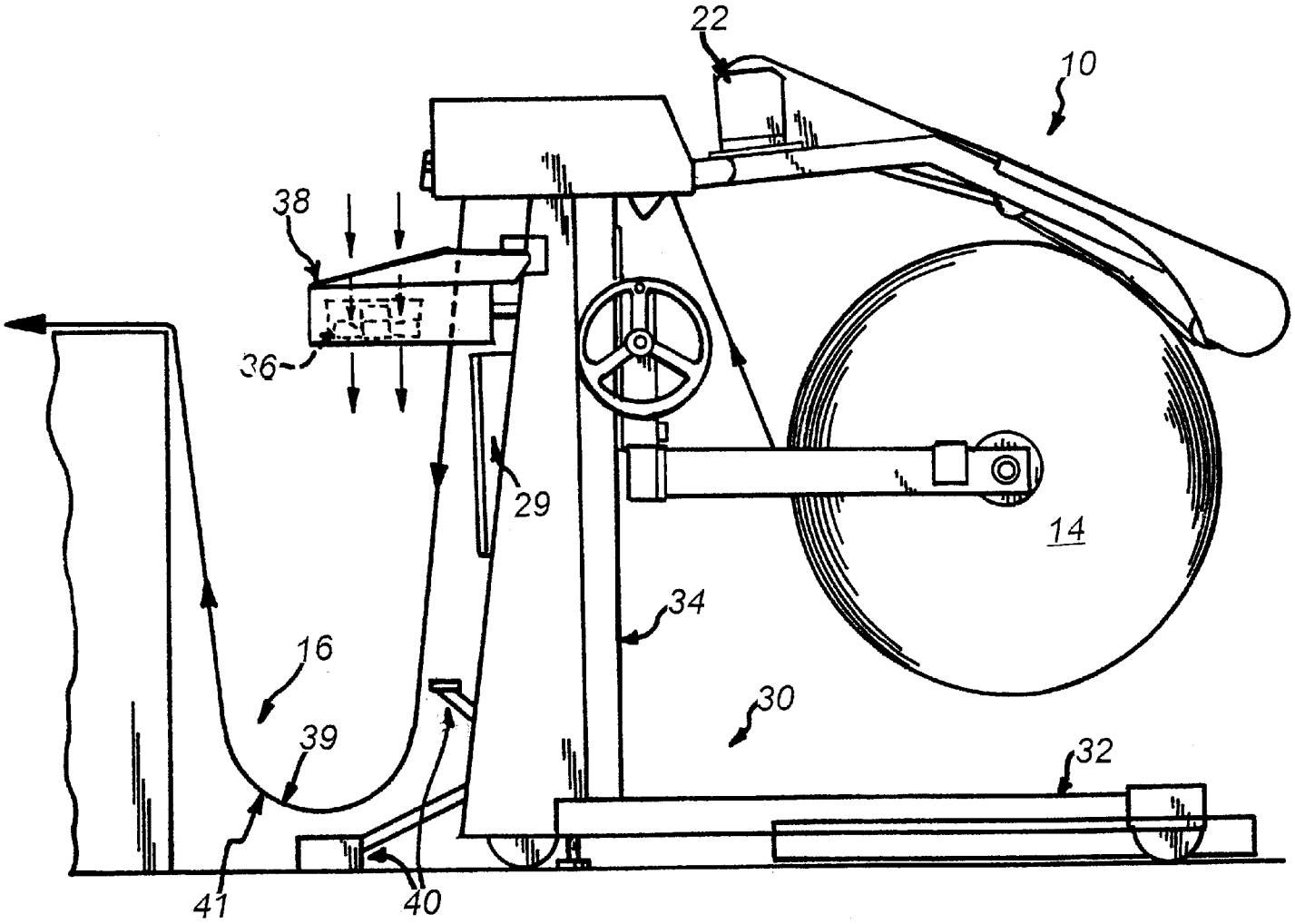
FIG. 2 is a side elevation view of a web feeder with a loop stabilization fan.

Reference is now made to FIG. 2, which shows a preferred embodiment of the present invention. A control box 29 is provided for operator control of the web feeding machine 10. The web feeding machine 10 has a frame 30 having base legs 32 and a pair of upright members 34. A fan 36 is mounted in a housing 38 on the upright members 34 and directs a stream of air downward toward the inner face 39 of the loop 16 of web material 14. The housing 38 may contain one or more fans 36 as necessary to stabilize the loop 16 while the web feeding machine 10 is in operation. Normally, this will require an air flow designed to impact the web material 14 in the loop 16 over its full width so as to overcome any external air currents in the operating environment. Fan requirements will vary depending on the rate of the web feeding process and the weight of the web material 14. In this embodiment, the air is forced directly downward. As is known in the art, an array of sensors 40 will typically be disposed around the loop 16 as necessary to accurately detect the shape of the outer face 41 of the loop 16 so that the motor 22 may be controlled to supply web material 14 at an appropriate rate. The sensors 40 may be ultrasound, infrared, or any other sensors as may be known in the art that are capable of detecting the distance to objects and transmitting an electrical signal corresponding to that distance. One such array of sensors is described in the above mentioned U.S. Pat. No. 5,472,153 to H. W. Crowley.

Figure 3:
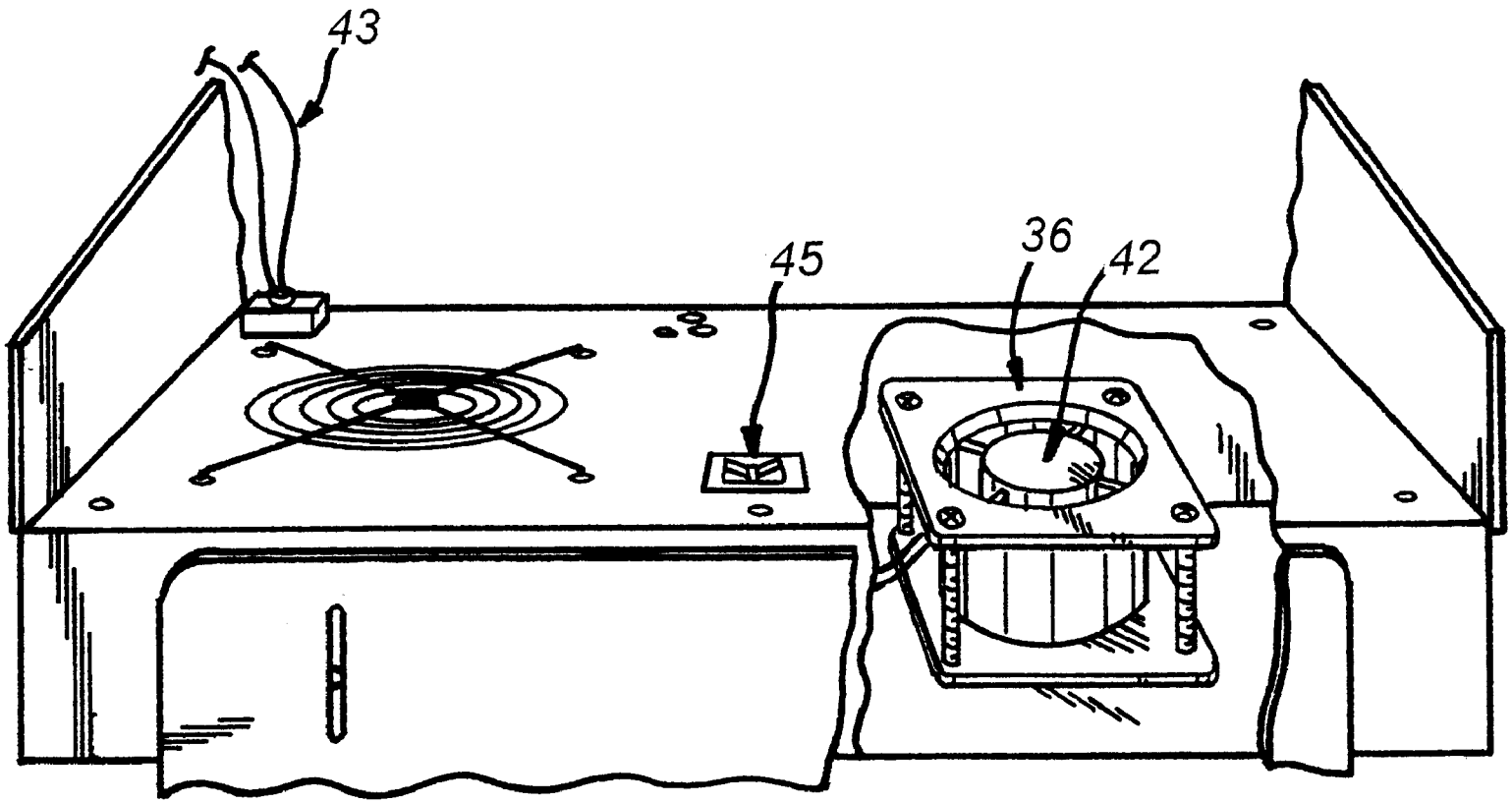
FIG. 3 is a cut-away view of two loop stabilization fans in a housing.

Reference is now made to FIG. 3, which shows in more detail a typical fan housing 38 having integral fans 36 and motors 42. There are a number of such fan units commercially available. The housing 38 contains two fans 36, each having a central motor 42. The fans 36 can direct a stream of air across the entire width of the loop 16 (FIG. 2). In this embodiment, each fan 36 has an air capacity of seventy cubic feet per minute. The fans 36 receive alternating current electrical power over electrical wire 43 and a manually operated switch 45 controls power to the fans 36.

It will be appreciated that a number of fans and housings are well known in the art, including fans that operate on direct current or alternating current, and that alternatives to rotary fans may be used, including compressed air as is commonly found in industrial environments, provided the source of forced air can provide at least seventy cubic feet per minute of air and that appropriate nozzles or baffles are available to direct the stream of air as desired. It should also be appreciated that the switch 45 for operating the power to the fans 36 may be remote from the housing 38, such as at a central control panel for the web feeding machine 10. It should further be appreciated that the air capacity required from each fan may vary depending on the speed of web feeding and the weight of the web material 14. Typically, each fan 36 will have an air capacity from seventy cubic feet per minute to five-hundred fifty cubic feet per minute. Examples of commercially available fans satisfying these requirements include the Rotron Caravel® Fan (550 CFM) and the Howard Industries NMB Boxer® Series B10 (70 CFM).

Figure 4:
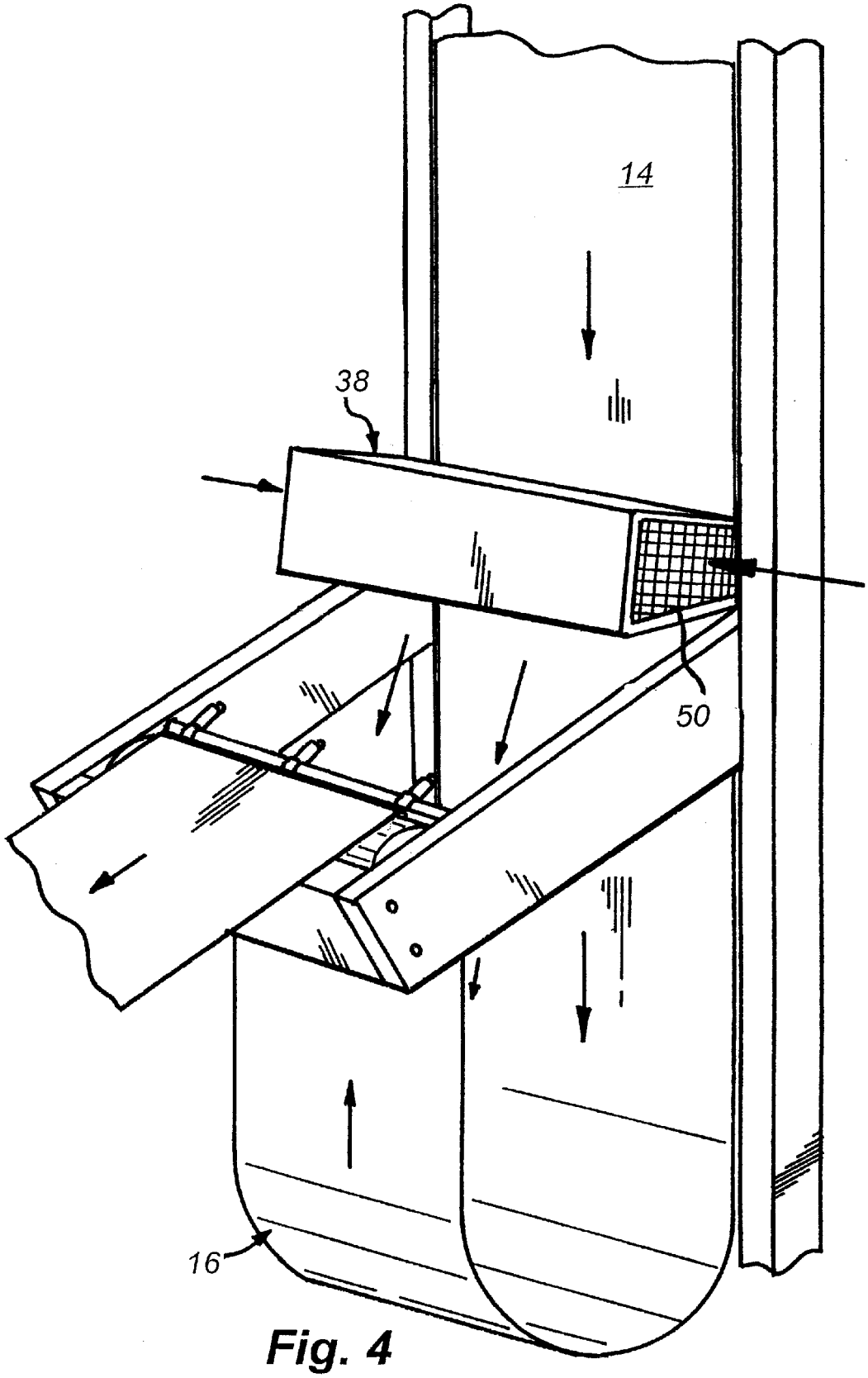
FIG. 4 is a perspective view of an alternate embodiment of the loop stabilization fan.

Reference is now made to FIG. 4, which shows an alternate embodiment of the fan mounting. In this embodiment, the housing 38 is oriented to direct the stream of air at an angle off from directly downward, which provides greater loop stability under some operating conditions. Altering the angle of air flow also creates different shapes in the loop 16 of web material 14, which permits greater selection in the placement of sensors 40 (FIG. 2) used to detect loop shape. The air intake vents 50 are disposed on the sides of the housing, which advantageously prevents the web material 14 from interfering with air flow through the housing 38, and which similarly prevents the air flow into the housing 38 from interfering with the stability of the free loop 16 of web material 14.

Figure 5:
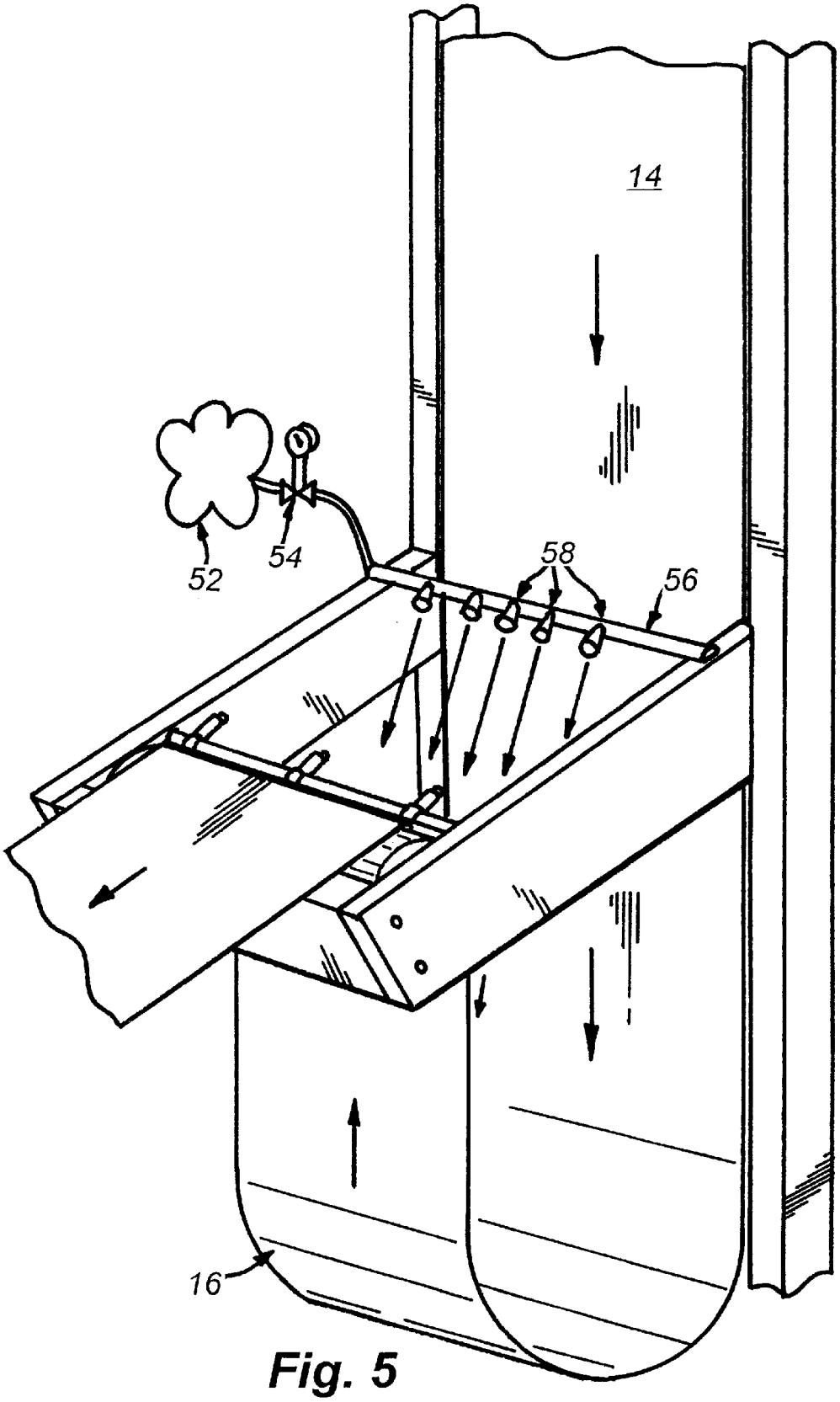
FIG. 5 is a perspective view of a compressed air embodiment of the loop stabilization apparatus.

As shown in FIG. 5, another embodiment employs forced air from an air compressor 52, as is commonly available in many industrial environments. In this embodiment, the flow rate is controlled by a regulator 54 which provides consistent air pressure in an air tube 56. This will generate a consistent flow rate through one or more nozzles 58, which may then be directed toward the loop 16 of web material 14 in order to stabilize the loop 16.

Figure 6:
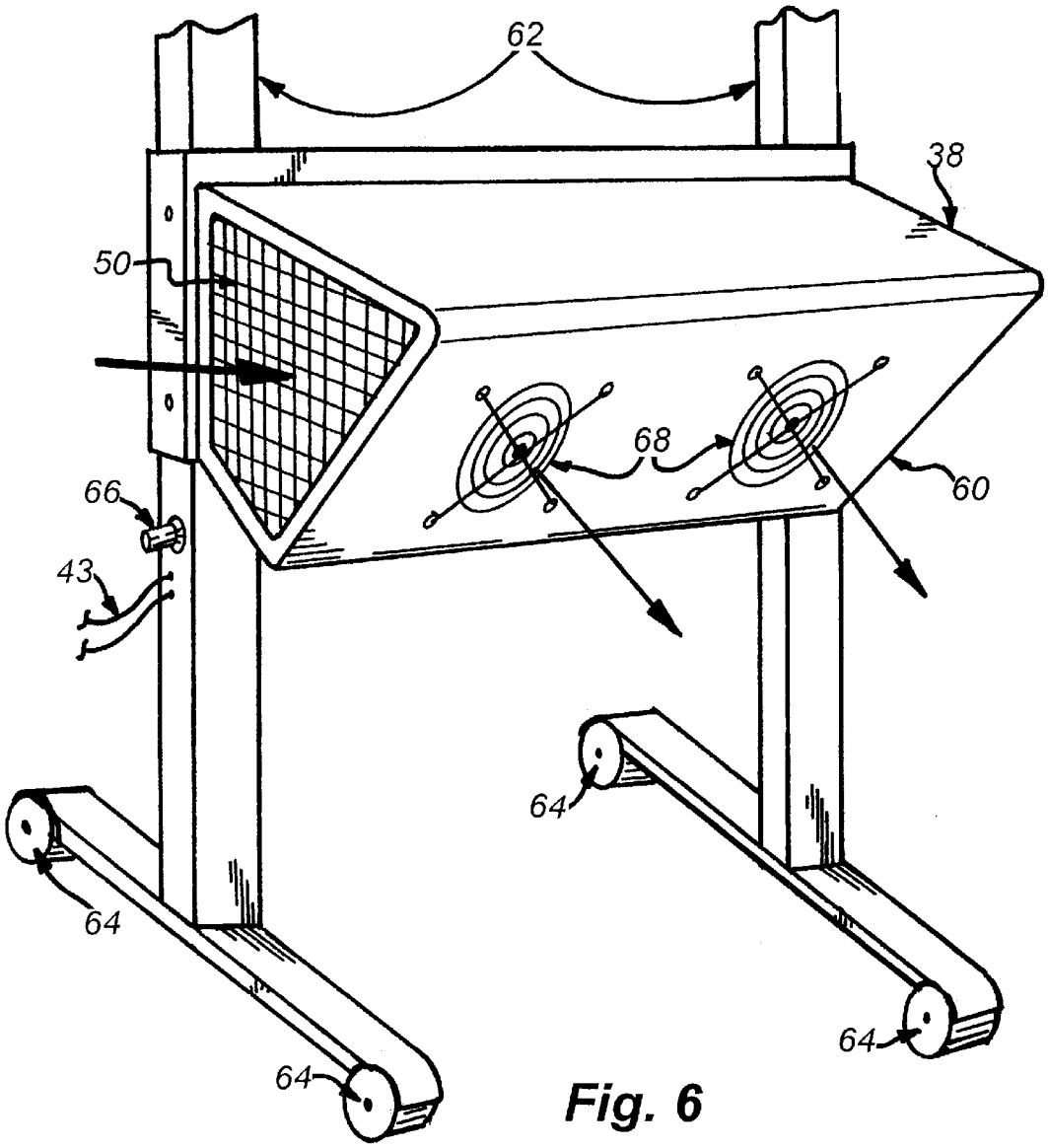
FIG. 6 is a perspective view of an alternate mounting for two loop stabilization fans.

Reference is now made to FIG. 6, which shows another fan mounting. In this embodiment, the housing 38 itself includes a beveled surface 60 where the fans (not shown) are mounted to direct air at a predetermined angle. The support posts 62 in this embodiment are separate from the web feeding machine 10 (FIG. 2), and attach to a set of wheels 64 so that the air source may be moved about independently from the web feeding machine 10 (FIG. 2). The air intake vents 50 are on the sides of the housing 38 to avoid interference with and from the web material 14 (FIG. 4). This embodiment receives electrical power over electrical wire 43, and includes an adjustment means 66 such as a knob so that the rate of forced air through the outlet vents 68 may be increased or decreased to achieve adequate loop stability for a particular web feeding application.

Figure 7:
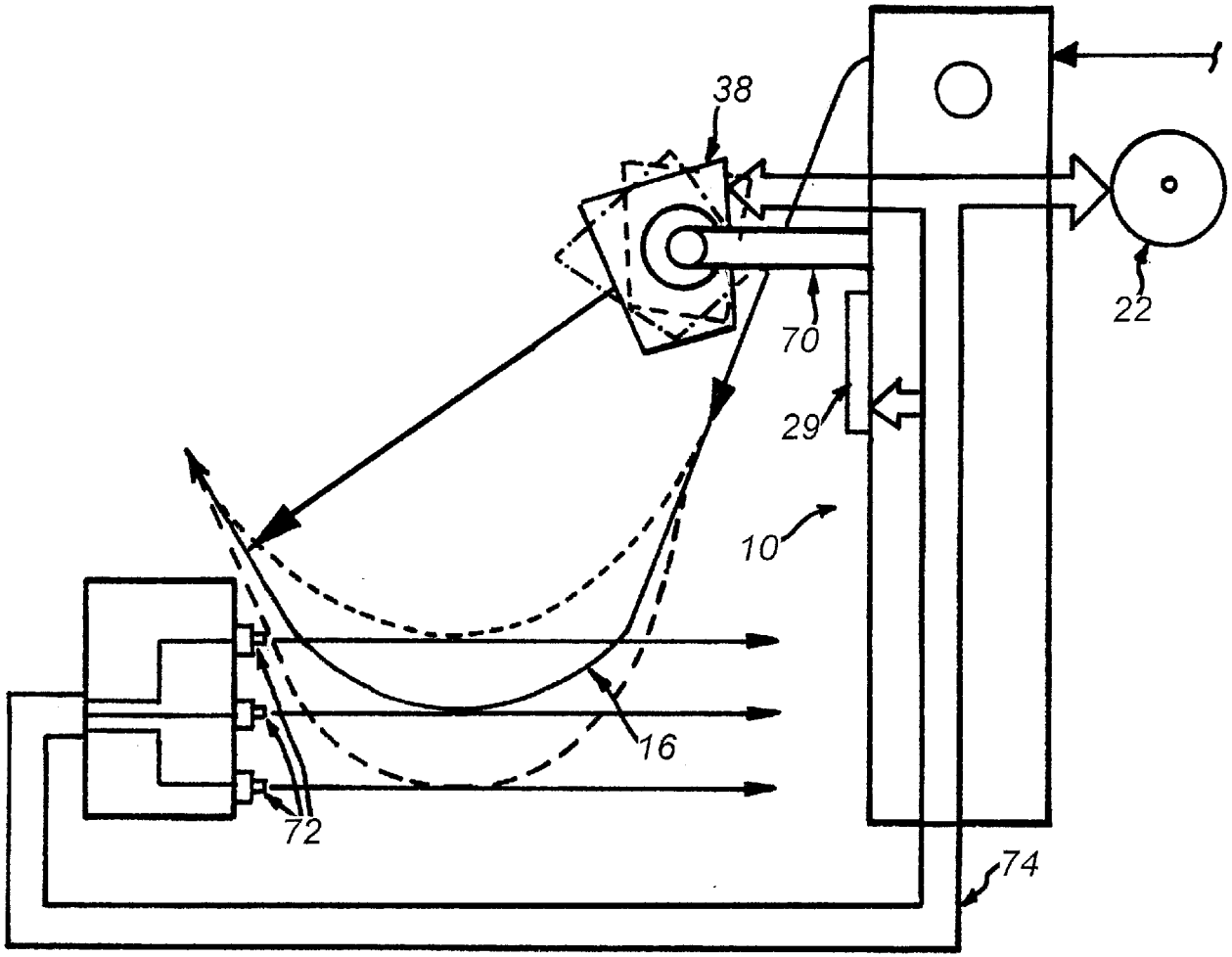
FIG. 7 is a schematic side view of a pivotally mounted fan embodiment of the invention.

Reference is now made to FIG. 7, which shows a pivotally mounted embodiment of the housing 38 employing a variety of control features. In this embodiment, the housing 38 is attached to the web feeding machine 10 with one or more extended arms 70. The extended arms 70 pivotally attach to the housing 38 so that the direction of the forced air may be adjusted to obtain a desired loop shape. An array of sensors 72 detects the bottom of the loop by sensing its lowest vertical point. In this embodiment, the sensors 72 may be ultrasound sensors, infrared sensors, or any other sensors as may be known in the art that are capable of detecting the presence of web material in predetermined areas and transmitting a corresponding electrical signal.

The sensors 72 transmit signals to the control box 29 over a communication bus 74 such as electrical wiring. The control box 29 uses the signals received from the array of sensors 72 to generate one or more motor control signals which are transmitted over the communication bus 74 to the motor 22 in order to drive the web feeding machine 10 at an appropriate rate to maintain the desired loop shape. The control box 29 further transmits a control signal to the fans (not shown) in the housing 38 to control the rate of forced air supplied by the fans. In this manner, the rate of forced air may be adjusted according to the web feeding rate and the depth of the loop in order to maximize loop stability. The control box 29 may be a computer, microcontroller, logic unit, or any other well known means for providing electromechanical control.

Figure 8:
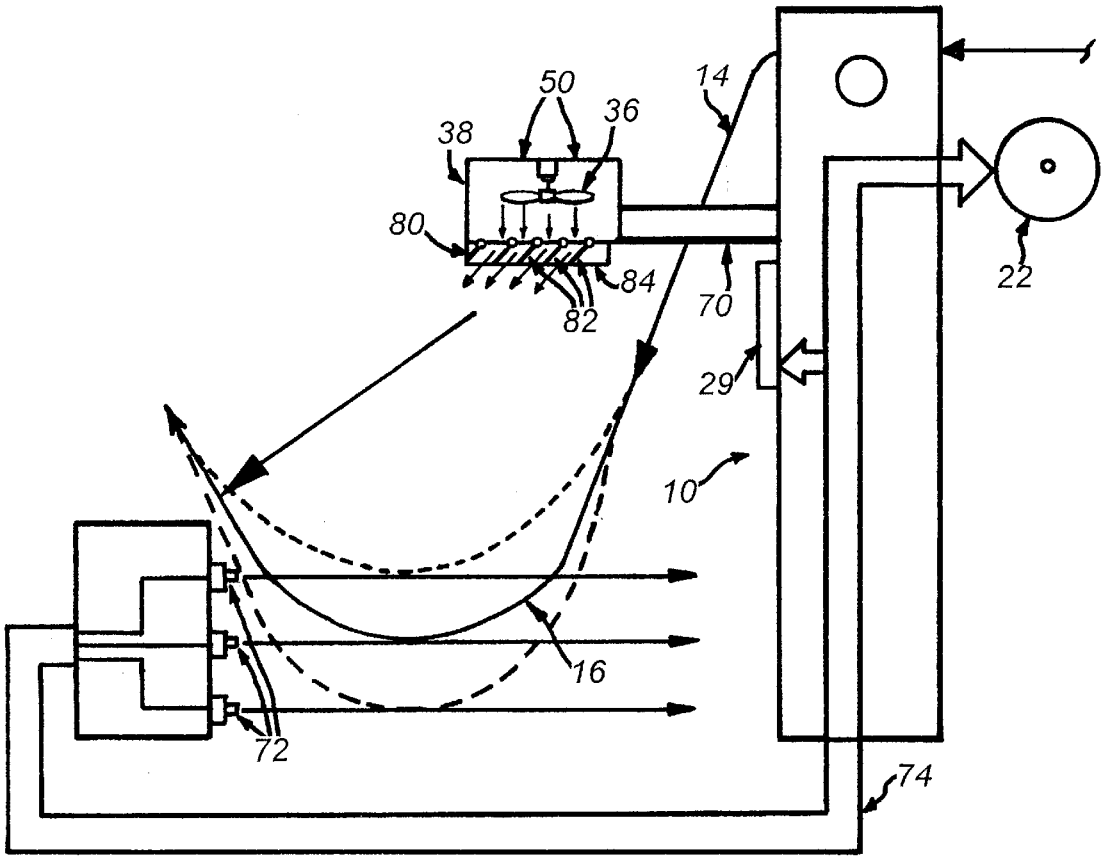
FIG. 8 is a schematic side view of a baffled fan embodiment of the invention.

As shown in FIG. 8, the direction and flow rate of the forced air may also be controlled by a baffle 80 with one or more louvres 82 at the housing outlet 84 for controling the direction and rate of air flow. The louvres 82 of the baffle 80 are secured in position so that the flow of air created through the housing 38 by the fans 36 is re-directed toward a desired point in the loop 16 of web material 14. If used only to control the rate of air flow, these baffles may alternately be placed at the air intake vents 50 to selectively slow the rate of flow through the housing 38.

Having now described several embodiments of the present invention along with certain variations thereof, it should be apparent to those skilled in the art that other modifications and other embodiments will also fall within the scope of the present invention as defined by the following claims. For example different arrangements of web handling devices may be used, such as a printer feeding to a web take-up device or a web feeder supplying web material directly to a rewind device for transferring material between rolls. Accordingly, this description is meant to be taken by way of example and not to otherwise limit the scope of this invention.

What is claimed is:

1. An apparatus for stabilizing a free loop between a first web handling device that feeds web material and a second web handling device that draws the web material from the first web handling device, the apparatus comprising:

a forced air source that directs air onto an inner face of the free loop;

a sensor that detects the position of the free loop;

a motor that controls a web speed of one of the first web handling device and the second web handling device;

a controller that receives signals from the sensor and generates responsive control signals to the motor so that the shape of the free loop is maintained; and a pivotally mounted housing for housing the forced air source wherein the pivotally mounted housing is constructed and arranged to allow adjustment of a direction of air of the forced air source.

2. The apparatus of claim 1 wherein the pivotally mounted housing further comprises a baffle.

3. The apparatus of claim 1 wherein the forced air source is constructed and arranged to direct a variable air flow rate therefrom.

4. The apparatus of claim 1 wherein one of the web handling devices comprises a web feeder and further wherein the forced air source is mounted on the feeder frame adjacent to the free loop.

5. The apparatus of claim 4 wherein the motor drives the web feeder.

6. The apparatus of claim 1 wherein the pivotally mounted housing further comprises at least one air intake vent disposed on a side of the housing and wherein the air intake vent advantageously prevents the web material from interfering with an air flow entering the housing and which similarly prevents the air flow entering the housing from interfering with the stability of the web material.

7. The apparatus of claim 1 wherein the pivotally mounted housing is attached to the first web handling device with at least one extended arm.

8. A method for stabilizing a free loop of material between two web handling devices, the method comprising the step of directing forced air through one or more fans mounted in a pivotally mounted housing toward an inner face of the free loop in order to maximize loop stability.

9. The method of claim 8 wherein the step of directing forced air further comprises directing forced air through a baffle.

10. An apparatus for stabilizing a free loop between a first web handling device that feeds web material and a second web handling device that draws the web material from the first web handling device, the apparatus comprising:

a forced air source that directs air onto an inner face of the free loop;

a sensor that detects the position of the free loop;

a motor that controls a web speed of one of the first web handling device and the second web handling device;

a controller that receives signals from the sensor and generates responsive control signals to the motor so that the shape of the free loop is maintained; and a housing for housing the forced air source wherein the housing includes a beveled surface and wherein the forced air source is mounted along the beveled surface to direct air onto an inner face of the free loop at a predetermined angle.

11. The apparatus of claim 10 wherein the housing further comprises at least one air intake vent disposed on a side of the housing wherein the air intake vent advantageously prevents the web material from interfering with an air flow entering the housing and which similarly prevents the air flow entering the housing from interfering with the stability of the web material.

12. The apparatus of claim 10 wherein the housing is mounted to a plurality of support posts wherein the support posts are separate from both the first web handling device and the second web handling device.

13. The apparatus of claim 12 wherein the support posts are attached to a set of wheels such that the air source may be moved independently from both the first web handling device and the second web handling device.

* * * * *